US005336474A

United States Patent [19]

Diehl et al.

[11] Patent Number: 5,336,474

[45] Date of Patent: Aug. 9, 1994

[54] PROCESS FOR LEACHING OF PRECIOUS METALS

[75] Inventors: Manfred Diehl; Karl-Heinz Koenig, both of Frankfurt am Main; Eckhart Krone, Bad Vilbel; Juergen Loroesch, Hanau-Steinheim; Norbert Steiner, Albstadt; Jochen Ullmann, Erlensee; Annette Ziegler, Offenbach, all of Fed. Rep. of Germany

[73] Assignee: Degussa Aktiengesellschaft, Frankfurt, Fed. Rep. of Germany

[21] Appl. No.: 956,317

[22] Filed: Oct. 6, 1992

Related U.S. Application Data

[63] Continuation-in-part of Ser. No. 875,340, Apr. 29, 1992, abandoned, and a continuation-in-part of Ser. No. 899,595, Jun. 18, 1992, abandoned.

[30] Foreign Application Priority Data

Jun. 2, 1990 [DE] Fed. Rep. of Germany ..... 4017899
May 3, 1991 [DE] Fed. Rep. of Germany ..... 4114514

[51] Int. Cl.[5] ..... B01D 11/00
[52] U.S. Cl. ..... 423/29
[58] Field of Search ..... 423/29

[56] References Cited

U.S. PATENT DOCUMENTS 732,605 6/1903 Thede ..... 423/29
4,971,625 11/1990 Bahr ..... 423/29

FOREIGN PATENT DOCUMENTS 587850 8/1989 Australia .
2043654 3/1991 Canada .
3801741 6/1989 Fed. Rep. of Germany .
4017899 11/1991 Fed. Rep. of Germany .
2631043 11/1989 France .

OTHER PUBLICATIONS

Worstell, J. H., "Precious Metal Heap Leaching in North America", Mining Magazine, (May 1986), pp. 405–411.

*Primary Examiner*—Paul J. Killos
*Attorney, Agent, or Firm*—Beveridge, DeGrandi, Weilacher & Young

[57] ABSTRACT

A process is disclosed for the leaching of gold and silver from ores and ore concentrates through intimate contact of the ore or ore concentrate with an aqueous leach solution containing cyanide. The leach solution has a pH of 8 to 13. The leaching process takes place in the presence of an oxygen-releasing peroxo compound. The separation of the formed cyano complexes of gold and silver takes place in a known manner. During leaching, at least one peroxoborate compound is present, in an effective quantity, as the peroxo compound. The peroxoborate is preferably a sodium or calcium peroxoborate. Compared to previously known leaching techniques in the presence of hydrogen peroxide or calcium peroxide, the leaching process according to the present invention provides a higher and/or faster precious metal yield and/or minimizes the consumption of cyanide and/or oxidizing agent.

31 Claims, No Drawings

PROCESS FOR LEACHING OF PRECIOUS METALS

REFERENCE TO A RELATED APPLICATION

The present application is a continuation-in-part of our copending U.S. patent application Ser. No. 07/875,340, filed on Apr. 29, 1992, abandoned and copending U.S. patent application Ser. No. 07/899,595, filed on Jun. 18, 1992, abandoned both of which are incorporated herein by reference in their entirety.

INTRODUCTION AND BACKGROUND

The present invention relates to a process for leaching of precious metals (e.g., gold and/or silver) from particle-shaped, solid materials, particularly ores and ore concentrates. The process includes the use of a cyanide-containing alkaline leach solution in the presence of a peroxo compound releasing oxygen. The present invention also relates to a process for leaching of such precious metals from ores, ore concentrates and waste material from previous incomplete leachings by grinding of the material to be leached in the presence of a cyanide-containing leaching solution which has a pH value of 8 to 13 and which contains a peroxo compound.

Leaching of precious metals involves the formation of cyano complexes (particularly complexes with gold and/or silver) from ores, ore concentrates, and other particle-shaped, solid materials. Such solid material may be available, for example, from mining waste material (or tailings), from previously incomplete leaching operations, or from electronic scrap. A leaching process using a cyanide-containing alkaline leach solution and an oxidizing agent, normally atmospheric oxygen, has long been known. Although air is widely used as an oxidizing agent for so-called leaching by agitation, as well as for heap leaching, there have been many attempts to increase leaching speed and the yield of precious metals (i.e., the degree of extraction) by using agents for releasing oxygen or other oxidizing agents.

Hydrogen peroxide has proved to be a suitable agent for increasing the oxygen concentration of the leach solution, thus accelerating leaching and increasing the degree of extraction. Oxygen in dissolved form is released by the decomposition of the hydrogen peroxide during leaching (see for example U.S. Pat. Nos. 732,605 and 3,826,723, and Canadian Patent 1,221,842; see also Japanese Kokai 01-270512). These processes were not considered viable solutions for a long time due to the large amount of hydrogen peroxide and sodium cyanide being used.

The problem that prevented a practical utilization of these processes (i.e., the excessive consumption of cyanide and hydrogen peroxide) was solved by the process mentioned in German Patent DE-PS 36 37 082. In this patent, a process is described wherein the addition of the aqueous $H_2O_2$ solution is adjusted via the concentration of the oxygen dissolved in the cyanidic leach solution, whereby the $O_2$ concentration should be situated in the range of 2 to 20 mg per liter (preferably 7 to 13 mg per liter).

In order to solve the same problem, German Patent DE-PS 38 01 741 (U.S. Patent No. 4,971,625 which is incorporated by reference in its entirety) suggests a different approach. In this patent, special molar ratios of hydrogen peroxide to cyanide are maintained, and specific pH-ranges are maintained, along with the addition of the total amount of hydrogen peroxide at the beginning of the leaching.

When using the process described in German Patent DE-PS 36 37 082 in gold mines, an unexpected high consumption of chemicals and/or an insufficient increase in the gold yield and/or a reduction of the leaching period occurred in some cases. This happened in spite of careful adjustment of the hydrogen peroxide dosage. An improvement could be obtained in some instances by simultaneous use of dissolved or solid decomposition catalysts for hydrogen peroxide (as described in European Patent Application EP-A 0 358 004). The concentration of free hydrogen peroxide could thereby be kept sufficiently low, whereby the consumption of cyanide and hydrogen peroxide could be lowered.

The chemical consumption, the maximum degree of extraction, and the pertinent leaching period apparently depend upon the chemical and physical properties of the material to be leached in some manner that is not immediately predictable.

Although the prior art processes which use hydrogen peroxide as an oxygen releasing source are often superior to the process using conventional air or oxygen-gasing techniques, a great interest persists in trying to further decrease chemical consumption and, during the shortest possible time, to obtain a maximum degree of extraction.

In British Patent Application GB-A 2,219,474, a further process of leaching gold-containing materials by using a diluted aqueous alkaline cyanide solution in the presence of an in situ compound releasing oxygen (e.g., a peroxide of a divalent metal, especially calcium peroxide) is described. The peroxide compound is applied either as a solid or a slurry produced from aqueous hydrogen peroxide and a divalent metal oxide or hydroxide. It is added to the ore pulp for leaching by agitation and it is added to the leaching material during filling up of the heap for heap leaching.

During reproduction of the process in British Patent Application GB-A 2,219,474, it appeared that, due to the relatively high chemical consumption, the plausibility of this process is rather restricted. More particularly, the consumption of the peroxo compound (in this instance the moles of calcium peroxide per ton ore for leaching by agitation) was significantly higher than the amount required for leaching according to the process of German Patent DE-PS 36 37 082 which utilizes hydrogen peroxide.

For some time now, certain mines have been using the so-called cyanidation-in-mill technique. In this method of leaching, the cyanide is added before or during grinding and the residence time of the ore in the mill is used to shorten the leaching time in the tanks used for agitation leaching. Whereas passable results can actually be obtained in the mill in the leaching of fully oxidized ores, this method is not really suitable for the leaching of sulfidic ores because, in their case, reductive conditions prevail in the mill and too little, if any, oxygen is available for leaching. To make sulfide-containing ores more accessible to the cyanidation-in-mill technique, oxidizing agents have also been used by various mines. Whereas no improvement could be obtained with pure oxygen, the gold yields in the mill could be increased and the consumption of NaCN reduced by using hydrogen peroxide (Chemical Abstracts 102(14): 117216r; Smith, M. E., et al. in Proc. SME Fall Meeting 1983, 41, 43–49, ed. Hiskey, J. Brent, Soc. Min. Eng. AIME: Littleton, Colo.).

SUMMARY OF THE INVENTION

One object of the present invention is to make available a process for leaching gold or silver or mixtures thereof from at least one of the particle-shaped solid materials containing these metals, especially ores and ore concentrates. The process includes bringing the above-mentioned solid, finely divided particulate materials into intimate contact with an aqueous leach solution having a pH in the range of 8 to 13 and containing cyanide in an amount of 0.005 to 2.5% by weight. The leach solution and metal are brought into contact in the presence of an oxygen-releasing peroxo compound in an amount of from 1 to 100 equivalents peroxoborate per ton of material to be leached. The materials are allowed to remain in contact for a period long enough to achieve the desired degree of extraction. As a result of this process, the subsequent separation of the formed cyano complexes of gold and silver from the leach solution enriched thereby is improved in terms of chemical consumption and/or the leaching period and/or the degree of extraction. To attain this and other objects of the invention, a feature of the present invention resides in using at least one peroxoborate compound as the peroxo compound in the leaching process.

Another object of the present invention is to improve the cyanidation-in-mill technique to the extent that an even higher gold yield could be obtained in relation to the use of hydrogen peroxide. Accordingly, it would be possible not only to further shorten the overall leaching time (time required for grinding and subsequent agitation leaching) for a high gold yield, but also—where possible—to dispense with the need for agitation leaching.

To attain this and other objects of the invention concerning the cyanidation-in-mill technique, one feature resides in a process for leaching gold and/or silver from ores, ore concentrates and waste material from previous incomplete leaching by grinding of the material to be leached in the presence of a cyanide-containing leaching solution which has a pH value of 8 to 13 and which contains at least one peroxoborate compound. It is crucial to the process according to the invention that an effective quantity of peroxoborate be present in dissolved and/or very finely divided form. The total quantity of peroxoborate required may be present in the mill from the beginning of the leaching process. Alternatively, the peroxoborate is added during leaching in one or more portions, for example before each grinding stage of a multistage grinding process. The peroxoborate may be added in powder form or as an aqueous solution or aqueous suspension to the material to be leached, to the cyanide-containing leaching solution, or to the leaching pulp.

DESCRIPTION OF THE INVENTION

The results of comparative tests of leaching by agitation using different oxygen-releasing peroxo compounds on the one hand, and atmospheric oxygen or pure oxygen on the other, are discussed below. These results establish that the degree of dissolved molecular oxygen is not the only determining factor for the leaching kinetics. Without being bound by any particular theory of operation, it appears that the applied peroxygen compounds and/or the secondary products produced from them, such as hydrogen peroxide and peroxo anions, play an important role in the leaching kinetics.

For an identical concentration of dissolved oxygen in the leach solution, as determined with an oxygen electrode, while maintaining the specified $O_2$ value during leaching, highly varying leaching results are obtained, as can be seen from Examples 2 to 5. These examples show the use of oxygen, hydrogen peroxide, calcium peroxide, or sodium peroxoborate-tetrahydrate respectively, as the oxidizing agents. Leaching in the presence of the added peroxoborate, as shown in Example 5, led to an entirely surprising result. Not only was the leaching accelerated and the degree of extraction increased compared to the other peroxo compounds, but the cyanide consumption (kg per ton ore) and the consumption of peroxo compound (mol per ton ore) could be lowered significantly. By using a peroxoborate, the economy of the generic-type process could be increased in a non-predictable manner in the specific case of ordinary leaching techniques, especially leaching by agitation and heap leaching.

As used herein, 1 to 100 equivalents peroxoborate (expressed as $BO_3$) is defined to include 1 to 130 equivalents peroxoborate (expressed as sodium perborate tetrahydrate ($NaBO_3.4H_2O$), 1 to 200 equivalents peroxoborate (expressed as sodium perborate monohydrate ($NaBO3.H_2O$), and 1 to 255 equivalents peroxoborate (expressed as $Ca(BO_3)_2$) per ton of material to be leached in leaching by agitation, heap leaching, and cyanidation-in-mill leaching.

For leaching by agitation, the material to be leached is brought into contact, in a finely divided form, with the leaching solution and the oxidizing agent in one or more leaching tanks. The thorough mixing during a leaching period lasting several hours can take place mechanically or through gasing with air. However, in case of gasing with air, problems peculiar to this technique, such as increased cyanide consumption resulting from hydrogen cyanide gasing out, can be expected. After leaching is completed, the fluid and solid phases of the leach slurry are separated from one another by conventional separation techniques known to those skilled in the art. Dissolved precious metal cyano complexes are separated from the liquid phase by means known to those skilled in the art (e.g., adsorption by coal or precipitation by means of zinc dust). Conventional leaching by agitation equipment is used for purposes of the present invention.

For the leaching technique characterized as heap leaching, the material to be leached, which is particle-shaped and may stem from a prior applied conventional agglomeration process, is stacked in a large heap and sprinkled for several days with an alkaline solution (known as barren solution) containing cyanide. The solution gathering at the bottom of the heap (pregnant solution) is fed back to the heap of particulate material after separation of the cyano complexes and adjustment of the pH value and the cyanide concentration in order to sprinkle the heap. This process is described in J. H. Worstell, *Mining Magazine,* May 1986, 405–411. Conventional heap leaching equipment is used for purposes of the invention.

For the specific embodiments of the invention relating to leaching by agitation and heap leaching, it is important that an effective amount of peroxoborate be present in a dissolved and/or most finely dispersed form. In carrying out the invention, the peroxoborate can be added to the system as a solid product, as an aqueous suspension, or as an aqueous solution, before and/or during leaching.

In case of leaching by agitation, the addition of the peroxoborate to the leach slurry is done in portions or continually, at the beginning and/or during leaching. The addition to the leach slurry, by portions or continually, generally represents a more profitable specific embodiment since it typically leads to less consumption of cyanide and peroxo compound.

In the case of heap leaching, the peroxoborate may be distributed as uniformly as possible in the material to be leached during filling up of the heap by superposition of the peroxoborate as an aqueous solution, aqueous suspension, or as a powder. Naturally, with heap leaching, the peroxoborate can also be added uniformly to the system with the barren solution during leaching, especially if it is sufficiently water soluble. This technique, however, is less preferred since it cannot always be assured that peroxoborate is available in an effective quantity in the lower layers of the heap. Provided that the material to be leached is converted to a granulate in an agglomeration process before the filling up of the heap, the peroxoborate can be added even during the agglomeration process.

One advantageous embodiment of this invention is characterized in that immediately before leaching, a solution or suspension of the peroxoborate in an aqueous phase is produced by combining a borate with aqueous hydrogen peroxide, whereupon the leach slurry of the leaching by agitation or the barren solution of the heap leaching is added to this peroxoborate solution or suspension in one or preferably more portions or continually. Starting from hydrogen peroxide and an alkali or alkaline earth metaborate solution or suspension, the alkali or alkaline earth peroxoborate is obtained in the form of a solution or suspension in a quickly established equilibrium reaction.

The term "peroxoborates" should be understood to include the peroxoborates themselves, the hydrates thereof, the peroxoborates of alkali and alkaline earth metals, and in principle, even peroxoborates of other metals (e.g., zinc). Sodium and calcium peroxoborate are especially preferred. Peroxoborates dissociate in an aqueous solution into the metal cation and the peroxoborate anion. According to Koberstein et al., in the *Journal of Inorganic and General Chemistry* (1970) volume 374 pages 125–127, the peroxoborate anion displays the following structure

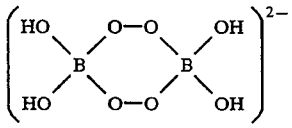

although normally only peroxoborate or perborate is being considered. The peroxoborate anion together with the metaborate anion and hydrogen peroxide are in equilibrium.

It is known that both hydrogen peroxide and peroxoborate belong to the class of compounds known as active or available oxygen compounds (i.e., they are able to release oxygen). The release of oxygen can take place in a more or less accelerated manner through the use of a decomposition catalyst contained in the material to be leached or added during leaching. The mechanism by which the peroxoborates in accordance with the present invention take effect has not yet been clarified. To the extent that preformed peroxoborates are being used, commercial products (e.g., sodium perborate mono- or tetrahydrates) are suitable. The superoxidized peroxoborates can also be added, as known from German Published Patent Applications DE-OS 28 11 554 and DE-OS 35 158. It is advantageous to use calcium peroxoborate if a peroxoborate which is less soluble compared to alkali peroxoborates is desired.

In accordance with a preferred specific embodiment of the present invention using leaching by agitation, an alkali or alkaline earth peroxoborate is added during leaching in such a quantity that an oxygen concentration in the range of 5 to 20 ppm is set and maintained in the leach solution (i.e., the fluid phase of the leach slurry). The oxygen concentration can be determined in any known manner (e.g., by using an oxygen electrode). In this manner, an overdosage of peroxoborate is avoided so that the overall result is minimum chemical consumption. The optimal correlation between the concentration of added peroxo compound and oxygen must be adjusted individually for the material to be leached. Such adjustment techniques are a matter of routine experimentation to one of ordinary skill in the art.

For heap leaching, preferably 0.05 to 100 mol alkali peroxoborate or 0.025 to 50 mol alkaline earth peroxoborate per ton of material to be leached (corresponding to 0.05 to 100 peroxoborate equivalents in both cases) is added to the material to be leached during filling up of the heap or during prior agglomeration. As can be seen from Examples 6 and 7, by using sodium peroxoborate, which is added as sodium peroxoborate tetrahydrate to the ore heap, it is possible attain a higher $O_2$ concentration in the leach solution trickling through the heap than by using an equimolar amount of calcium peroxide. When using calcium peroxide, however, only an $O_2$ concentration in the leach solution identical to the one for conventional heap leaching in the presence of atmospheric oxygen alone could be observed. Leaching according to the present invention is significantly favored by the presence of the peroxoborate anion and/or its secondary products. This is in contrast to leaching with the previously known process using $CaO_2$ (GB-A 2,219,474).

The leaching solution contains 0.005 to 2.5% per weight cyanide (computed as CN) and preferably 0.02 to 0.2% by weight cyanide. Alkali or alkaline earth cyanides may be used as the cyanide. Preferably sodium cyanide and calcium cyanide (also known as "Black-Cyanide") is used. The pH value during leaching is typically 8 to 13 and preferably 9 to 12. The pH may be adjusted in a conventional manner, preferably by adding soda liquor or lime milk. It should be remembered that the alkalinity of the alkali or alkaline earth peroxoborate to be added according to the invention contributes to the pH adjustment, and the amount of soda liquor or milk of lime can be reduced in accordance therewith.

The concentration of the leach slurry according to the present invention (i.e., the amount of material to be leached in the slurry) is situated within the normal range known from leaching by agitation using air gassing (i.e., approximately 30 to 60% by weight). The slurry per ton of material to be leached contains preferably 1.5 to 1 $m^3$ leach solution (this term is understood to include the entire liquid phase of the leach slurry).

The precious metal containing ore material to be leached is treated in the form of particles. The finer the particulate material, the faster the leaching occurs. In practice, mostly material with a particle size within the range 0.02 to 0.2 mm is treated by agitation leaching. For heap leaching, the ore material having a particle size within the range of 5 to 25 mm is treated. The material also may include agglomerates of the most finely ground material. The particle size distribution may also be outside these ranges if it appears useful in terms of the ore or ore concentrate to be leached, as well as of the operational conditions of the mine.

Before leaching by agitation or heap leaching in accordance with the present invention, the material to be leached, mostly ore, ore concentrates, or mining waste material from previous leachings, may be leached in the presence of atmospheric air. For leaching according to the present invention, atmospheric air may be present in addition to the peroxoborate compound. For heap leaching, depending on the process used, this is normally the case. In leaching by agitation, depending on the process used, air frequently serves not only as a source of oxygen but at the same time it is used as a source of agitation to thoroughly mix the slurry. In individual cases, before cyanidic leaching, it may be expedient to subject the material to be leached to an oxidative pretreatment (e.g., by using hydrogen peroxide ).

When leaching in accordance with the present invention, the leaching by agitation or heap leaching technique may include various known substances additionally being contained in the leaching solution or the barren solution in order to optimize the execution of the leaching and/or to increase and/or to accelerate the yield of gold and silver and/or to reduce the consumption of cyanide and oxidizing agent. These additional substances may include effective surfactants (e.g., alkali-stable tensides) which serve to improve the wetting and penetration of the materials to be leached. Foam inhibitors or defoamers, which are useful for leaching of heavily foaming materials (e.g., biologically pretreated ore concentrates), may also be included. Finally, the addition of flotation chemicals from the series of thiocarbonates, thiophosphates, thiocarbaminates, or anionic polymers, particularly from the series of polyacrylic acids, starches, carboxymethyl cellulose, has proved to be advantageous for the depressing or masking of iron and copper in ores containing such metals, so as to minimize the need for cyanide and/or oxidizing agent (see DE-PS 38 01 741). Such additives, adjuvants, and auxiliary agents may be added to contribute their expected function as will be apparent to those skilled in the art.

To the extent that it is advantageous and desirable (which may be tested in a normal leaching test), leaching according to the invention may also take place in the presence of substances additionally added in order to accelerate the release of oxygen from the peroxoborate or the intermediately formed hydrogen peroxide. The additives may include decomposition catalysts from the series of heavy metals acting destructively and/or solid substances with destructively acting centers, preferably manganese(II) compounds or active carbon, as described EP-A 0 358 004.

The process according to the invention may also be carried out in the form of a CIL process (CIL =Carbon In Leach). In order to separate gold and silver from their solutions containing cyano complexes, conventional processes are considered, particularly the CIP process (CIP=Carbon-in-Pulp), the Merrill-Crowe process, and the Ion-Exchanger process. Such techniques are known to those skilled in the art.

The following examples, with peroxoborate as the oxidizing agent for leaching by agitation and heap leaching relative to previously known oxidizing agents (e.g., air, oxygen, hydrogen peroxide, and calcium peroxide ) demonstrate the superiority of the leaching process according to the present invention. The superiority is evidenced in the unexpectedly low consumption of cyanide and peroxoborate, and also in the acceleration of the leaching and the higher degree of extraction.

EXAMPLES

Examples 1 to 5 (leaching by agitation)

A gold ore from South Africa was leached. The ore was bornite-containing and included 6.5 g gold per ton of ore. The granularity was 80% less than 75 μm. The ore was leached in a leaching tank with mechanical intermixing. The cyanide concentration of the leach solution, at the beginning of the leaching, was adjusted to 0.1% by weight NaCN by using sodium cyanide; additional sodium cyanide was added as needed in order to maintain a minimum concentration of 0.03% by weight NaCN. The solid-substance content of the slurry was 50% by weight. The pH value was adjusted and maintained at 10.8.

In Example 1, air gassing was used (1l/h and kg ore). In Examples 2 to 5, a constant $O_2$ level of 12 ppm was set and maintained in the leach solution. The oxidizing agent was added, spread over the leaching period, as needed. the results of the leaching, measured in the degree of extraction as a function of time, the NaCN consumption (kg per ton ore), and the consumption of oxidizing agent (mol per ton ore) can be seen from Table 1. In Table 1, Example 5 represents the process in accordance with the present invention.

TABLE 1

| | Leaching by Agitation | | | | |
|---|---|---|---|---|---|
| Example No. | 1 | 2 | 3 | 4 | 5 |
| Oxidizing agent | Air | $O_2$ | $H_2O_2$* | $CaO_2$** | $NaBO_3.4H_2O$*** |
| Gold extraction (%) after | | | | | |
| 1 h | 58.7 | 59.3 | 62.0 | 61.1 | 67.0 |
| 4 h | 71.0 | 72.7 | 75.1 | 74.1 | 79.8 |
| 8 h | 85.0 | 87.1 | 89.7 | 88.9 | 94.3 |
| 24 h | 89.3 | 89.7 | 93.3 | 91.4 | 95.3 |
| NaCN consumption (kg/t ore) | 1.73 | 1.70 | 1.75 | 1.72 | 1.43 |
| Consumption of oxidizing agent in (mol/t ore) | | 62.5 | 18.5 | 54 | 12.5 |
| $O_2$ concentration | slow exit | fast ascent | 12 ppm | 12 ppm | 12 ppm |

TABLE 1-continued

| | Leaching by Agitation | | | | |
|---|---|---|---|---|---|
| Example No. | 1 | 2 | 3 | 4 | 5 |
| Oxidizing agent | Air | $O_2$ | $H_2O_2$* | $CaO_2$** | $NaBO_3.4H_2O$*** |
| | of 0.5 to 8 ppm within 22 h | (in ca. 0.5 h) to 12 ppm | | | |

*Addition as 1% by weight aqueous $H_2O_2$ solution
**Addition as 60% by weight calcium peroxide (powdery)
***Addition as sodium perborate tetrahydrate (powdery)

Examples 6 to 8 (Heap Leaching)

A gold ore from Xapetuba (Brazil) with a gold content of 1 g/t ore was leached. Grain-size distribution of the ore was 2 to 20 mm. In Example 6, calcium peroxide was used. In Example 7, sodium perborate tetrahydrate, as per the invention was used. The oxidizing agent was added in an equimolar amount (i.e., 15.3 mol per ton ore). The oxidizing agent was distributed evenly in the ore stack.

Subsequently, sprinkling with the barren leach solution was done. The leach solution was added in the amount of 1 l per day per 6 kg ore quantity. The pH value of the barren solution was adjusted with calcium oxide to 10.5 and maintained. The sodium cyanide concentration was set to 0.1% by weight. Leaching occurred during the entire test period with the leach solution adjusted in this manner (in other words, without feedback or recycling of the pregnant solution). The results can be seen in Table 2.

TABLE 2

| | Heap Leaching | | |
|---|---|---|---|
| Example | 6 | 7 | 8 |
| Oxidizing agent | $CaO_2$ | $NaBO_3.4H_2O$ | Air |
| Degree of extraction (%) | | | |
| after the 1st day | 10.7 | 12.4 | 8.9 |
| after the 2nd day | 21.0 | 25.4 | |
| after the 3rd day | 29.2 | 34.6 | 27.9 |
| after the 4th day | 34.0 | 42.2 | 31.3 |
| after the 9th day | 47.8 | 67.1 | 44.0 |
| after the 10th day | 49.6 | 70.3 | 46.1 |
| after the 15th day | 59.4 | 84.4 | 58.0 |
| NaCN consumption (kg/t ore) after 15 days | 0.39 | 0.38 | 0.38 |
| Oxidizing agent (mol/t ore) | 15.3 | 15.3 | |

In Example 8, air served as the oxidizing agent.

The $O_2$ concentration of the leach solution in Examples 6 and 7 is also shown in Table 3.

TABLE 3

| | Example | |
|---|---|---|
| | 6 | 7 |
| | Peroxo compound | |
| $O_2$ concentration (ppm) | $CaO_2$ | $NaBO_3.4H_2O$ |
| after 8 hours | 7.9 | 16 |
| after 24 hours | 8.1 | 14 |
| after 36 hours | 8.5 | 11.5 |
| after 2 days | 8.3 | 10.8 |
| after 3 days | 8.1 | 9.0 |
| after 4 days | 8.0 | 8.4 |
| after 6 days | 7.8 | 7.9 |
| after 8 days | 7.5 | 7.5 |
| after 10 days | 7.8 | 7.8 |
| after 15 days | 7.2 | 7.6 |

Further in accordance with the present invention concerning cyanidation-in-mill leaching, the effective quantity of peroxoborate, which depends to a large extent on the material to be leached, may readily be determined by preliminary test. A quantity of 1 to 100 equivalents peroxoborate, expressed as $BO_3$–, per ton of the material to be leached will generally be sufficient. The quantity of peroxoborate added is preferably between 10 and 60 equivalents. As active oxygen compounds, peroxoborates and the hydrogen peroxide formed by hydrolysis give off oxygen. The oxygen, the hydrogen peroxide and the peroxoborate may serve as oxidizing agents in the leaching process.

Suitable peroxoborates, by which are also meant hydrates thereof, are those of the alkali and alkaline earth metals, although peroxoborates of other metals, such as zinc for example, may also be used in principle. Commercially available peroxoborates, namely the so-called sodium perborate mono- and tetrahydrate and also calcium perborate, may be used with particular advantage. So-called superoxidized perborates, which are known from DE-OS 28 11 554 and from DE-OS 35 05 158, incorporated herein by reference may also be used.

In the same way as heap and agitation leaching, cyanidation-in-mill leaching is also carried out at a pH value of 8 to 13 and preferably at a pH value of 9 to 12. The pH value is adjusted in known manner with alkalis, such as in particular milk of lime and sodium hydroxide. It may be advisable during the grinding process to adapt the pH to values recognized as optimal.

The cyanide content, expressed as CN, in the leaching solution is normally between 0.005 and 2.5% by weight. Cyanide contents of 0.02 and 0.2% by weight are preferred. Cyanide is used in the form of alkali metal cyanide, more particularly sodium cyanide, or in the form of calcium cyanide, for example in the form of so-called black cyanide. The cyanide may be added in solid or dissolved form to a water-based pulp containing the material to be leached or, alternatively, a cyanide-containing leaching solution is directly used for the preparation of the leaching pulp. These cyanide leaching solutions are known in the art.

Known wet grinding units may be used for leaching in accordance with the invention, ball mills and rod mills being preferred. The grinding time depends on the material to be leached and the desired degree of extraction. The grinding time is normally between 15 minutes and 2 hours. The solids concentration of the leaching pulp during grinding may vary within wide limits and is normally between 25 and 60% by weight. The degree of grinding may be in the range typical of agitation leaching.

On completion of grinding, the leaching pulp may if necessary be subjected to agitation leaching or to pressure leaching in order to further increase the extraction level. Otherwise the noble metal/cyano complexes present in dissolved form in the leaching pump may be separated off for the further extraction of noble metal by known processes, for example by the carbon-in-pulp (CIP) and resin-in-pulp (RIP) processes and by the Merrill-Crowe process.

Whereas the extraction kinetics observed during cyanidation-in-mill leaching are similar to those observed during agitation leaching in accordance with German Patent 36 37 082 where hydrogen peroxide is used as the oxidation agent, extraction is surprisingly accelerated by using an equivalent quantity of a peroxoborate. The gold yield is thus increased for the same leaching time. In some cases, therefore, there is no need for agitation leaching after leaching in the mill. In addition, the use of peroxoborate reduces the consumption of cyanide. The factors mentioned increase the economy with which gold and silver are leached from ores, ore concentrates and waste material from previous incomplete leachings, for example heap leachings.

The advantages of the peroxoborates are all the more surprising insofar as other peroxo compounds, including calcium peroxide, sodium percarbonate and ammonium peroxodisulfate, proved to be less effective than hydrogen peroxide in regard to the gold yield.

The following Examples illustrate the surprising effect of peroxoborates in relation to other peroxo compounds in cyanidation-in-mill leaching.

Examples (cyanidation-in-mill leaching)

A sulfide-containing ore, the so-called mill feed of the Vumbachikwe mine in Zimbabwe, was used in all the tests With this ore, the cyanide-leachable gold, 80 to 85% of the gold content, can be extracted in 4 to 6 hours where hydrogen peroxide is used in accordance with DE-PS 36 37 082.

The leaching tests using the cyanidation-in-mill technique were carried out in a stainless steel rod mill with a total capacity of 4.5 1. Twelve stainless steel rods (18.2 cm long, 2.5 cm in diameter) were used as the grinding elements, occupying 24% of the mill volume. The grindings were each carried out with 400 g ore and 600 g water (40% solids). The volume of the ore pulp formed occupies another 6% of the mill so that the total filling of the mill is 40%.

Other leaching parameters are:
NaCN addition: 0.5 kg/t ore
CaO addition: 1.25 kg/t ore
Grinding time: 1 hour
Grinding speed: 60 r.p.m.
pH at the end of grinding: 11.5–12.0

The various oxidizing agents and the lime were introduced into the mill at the beginning of grinding. On completion of grinding, the gold yield (leached gold, based on the total gold content of the ore), the $O_2$ content (ppm) in the leaching solution, as determined with an $O_2$ electrode, and the cyanide consumption in kg/t ore (cyanide used minus residual cyanide) were determined.

The results of Examples E 1 to E 4 according to the invention and those of Comparison Examples C 1 to C 7 are set out in the following Table 4, reflecting the superior effect of added perborates (E 1 to E 4). Directly added peroxoborate, corresponding to 40 mole $H_2O_2$/ton ore, resulted in all cases in a significantly increased gold yield and lower cyanide consumption in comparison to in situ formed peroxoborate (E 5).

TABLE 4

| Test No. | Oxidizing agent | Quantity of peroxo compound, expressed as mol $H_2O_2$/t ore | Gold Yield % | $O_2$ content after grinding pmm | NaCN consumption kg/t ore |
|---|---|---|---|---|---|
| C 1 | $H_2O_2$ | 20 | 64 | 0.8 | 0.30 |
| C 2 | $H_2O_2$ | 40 | 66 | 1.3 | 0.35 |
| E 1 | $NaBO_3.4H_2O$ | 20 | 67 | 0.9 | 0.27 |
| E 2 | $NaBO_3.4H_2O$ | 40 | 84 | 2.7 | 0.20 |
| E 3 | $NaBO_3.H_2O$ | 40 | 76 | 1.9 | 0.25 |
| E 4 | $Ca(BO_3)_2$ | 40 | 76 | 2.9 | 0.24 |
| E 5 | $H_2O_2 + Na_2B_4O_7$ (in situ perborate) | 40 | 65 | 0.5 | 0.26 |
| C 3 | $CaO_2$ | 40 | 48 | 0.8 | 0.37 |
| C 4 | $Na_2CO_3.1.5\ H_2O_2$ | 40 | 54 | 0.8 | 0.22 |
| C 5 | $(NH_4)_2S_2O_8$ | 40 | 40 | 0.3 | 0.37 |
| C 6 | Caroat ® (Degussa AG) | 40 | 0 | 0.1 | Complete cyanide oxidation |
| V 7 | Air | — | 54 | 0.7 | |

Further variation and modification of the foregoing will be apparent to those skilled in the art and are intended to be encompassed by the claims appended hereto.

Priority documents, German Patent Application P 40 17 899.4, filed in Germany on Jun. 2, 1990, and German Patent Application P 41 14 514.3, filed in Germany on May 3, 1991, are relied on and incorporated herein by reference.

What is claimed:

1. A process for leaching gold or silver or mixtures thereof from particulate solid material containing at least one of said gold or silver, comprising:

leaching said solid material by intimately contacting said solid material with an aqueous leaching solution having a pH in the range of 8 to 13, said leaching solution comprising 0.005 to 2.5% by weight of cyanide, said contacting taking place in the presence of an oxygen-releasing peroxo compound, said peroxo compound being present in an amount of from 1 to 100 equivalents peroxoborate per ton of said solid material, said contacting being for a sufficient period of time to obtain a desired degree of extraction of gold and/or silver, thus forming cyano complexes of gold and/or silver; and separating the cyano complexes of gold and/or silver from the leaching solution, wherein at least one peroxoborate compound is used as said peroxo compound and wherein said peroxoborate is added as a solid product, an aqueous suspension or an aqueous solution before or during said leaching.

2. The process according to claim 1, wherein said peroxoborate is sodium or calcium peroxoborate.

3. The process according to claim 1, wherein said peroxoborate is sodium perborate mono- or tetrahydrate.

4. The process according to claim 1, wherein said peroxoborate is alkali or alkaline earth metal peroxoborate.

5. The process according to claim 1, wherein said cyanide CN is present at 0.02 to 0.2% by weight.

6. The process according to claim 1, wherein said cyanide is selected from the group consisting of alkali and alkaline earth cyanides.

7. The process according to claim 6, wherein said alkali cyanide is sodium cyanide.

8. The process according to claim 6, wherein said alkaline earth cyanide is calcium cyanide.

9. The process according to claim 1, wherein said pH is 9 to 12.

10. The process according to claim 1, wherein atmospheric air is present with said peroxoborate.

11. The process according to claim 1, further comprising an oxidative pretreatment.

12. The process according to claim 11, wherein said oxidative pretreatment comprises use of hydrogen peroxide.

13. The process according to claim 1, further comprising the use of surfactants, foam inhibitors or defoamers, or floatation chemicals, said flotation chemicals selected from the group consisting of thiocarbonates, thiophosphates, thiocarbaminates, and anionic polymers.

14. The process according to claim 1, wherein said solid material is in the form of an ore or an ore concentrate.

15. The process according to claim 1, wherein said contacting occurs in a leaching by agitation manner by bringing said solid material into contact with said leaching solution and said peroxo compound in one or more leaching tanks to form a leach slurry.

16. The process according to claim 15, wherein said peroxoborate is added in portions or continually at the beginning of and/or during said leaching.

17. The process according to claim 16, wherein said peroxoborate is added during said leaching in a quantity sufficient to produce and maintain an oxygen concentration of 5 to 20 ppm in the fluid phase of said leach slurry.

18. The process according to claim 17, wherein the oxygen concentration is 8 to 15 ppm.

19. The process according to claim 15, wherein most of said solid material has a particle size of 0.02 to 0.2 min.

20. The process according to claim 1, wherein the contacting occurs in a heap leaching manner by stacking said solid material in a large heap, sprinkling said solid material to be leached with a barren solution comprising cyanide, allowing a pregnant solution to gather at the bottom of the heap, separating said cyano complexes, feeding said pregnant solution back to said heap after adjustment of pH value and cyanide concentration.

21. The process according to claim 20, wherein said peroxoborate is added as uniformly as possible to said solid material during filling of said heap by superposition of said peroxoborate as an aqueous solution, aqueous suspension, or powder.

22. The process according to claim 20, wherein said peroxoborate is added as 0.05 to 100 mol alkali peroxoborate or 0.025 to 50 mol alkaline earth peroxoborate.

23. The process according to claim 20, wherein most of said solid material has a particle size of 2 to 25 mm.

24. The process according to claim 1, consisting essentially of:

leaching said solid material by intimately contacting said solid material with an aqueous leaching solution having a pH in the range of 8 to 13, said leaching solution comprising 0.005 to 2.5% by weight of cyanide and optionally surfactants, foam inhibitors or defoamers, or floatation chemicals, said flotation chemicals selected from the group consisting of thiocarbonates, thiophosphates, thiocarbaminates, and anionic polymers, said contacting taking place in the presence of an oxygen-releasing peroxo compound, said peroxo compound being present in an amount from 1 to 100 equivalents peroxoborate per ton of said solid material, said contacting being for a sufficient period of time to obtain a desired degree of extraction of gold and/or silver, thus forming cyano complexes of gold and/or silver; and separating the cyano complexes of gold and/or silver from the leaching solution, wherein at least one peroxoborate compound is used as said peroxo compound and wherein said peroxoborate is added as a solid product, an aqueous suspension or an aqueous solution before or during said leaching.

25. The process according to claim 1, further comprising the use of flotation chemicals selected from the group consisting of polyacrylic acids, starches, and carboxymethyl cellulose.

26. A process for leaching gold and/or silver from ore, ore concentrate and waste material from previous incomplete leachings comprising grinding material to be leached in the presence of a cyanide-containing leaching solution which has a pH value of 8 to 13 and which contains a sufficient amount of at least one peroxoborate compound to obtain the desired degree of extraction of gold and/or silver.

27. The process as claimed in claim 26, wherein the leaching solution contains an alkali metal and/or alkaline earth metal peroxoborate in dissolved and/or undissolved form.

28. The process as claimed in claim 26, wherein a powder-form peroxoborate is added in an sufficient amount to pulp of said material to be leached and the leaching solution at the beginning of and/or during said grinding.

29. The process as claimed in claim 26, wherein 1 to 100 equivalents peroxoborate are used per ton of said material.

30. The process as claimed in claim 29 wherein 10 to 60 equivalents are used.

31. The process as claimed in claim 26, wherein said leaching solution has a pH value of 9 to 12 and contains 0.02 to 0.2% by weight cyanide, expressed as CN.

* * * * *